US011122854B2

(12) United States Patent
Adami et al.

(10) Patent No.: US 11,122,854 B2
(45) **Date of Patent: *Sep. 21, 2021**

(54) FOOTWEAR UPPER HAVING SELECTIVELY LOCATED PADDING

(71) Applicant: NIKE, Inc., Beaverton, OR (US)

(72) Inventors: Giovanni Adami, Montebelluna (IT); Sergio Cavaliere, Venice (IT); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 150 days.

This patent is subject to a terminal disclaimer.

(21) Appl. No.: 16/195,233

(22) Filed: Nov. 19, 2018

(65) Prior Publication Data

US 2019/0082777 A1 Mar. 21, 2019

Related U.S. Application Data

(63) Continuation of application No. 14/269,239, filed on May 5, 2014, now Pat. No. 10,136,695, which is a (Continued)

(51) Int. Cl.
*A43B 23/02* (2006.01)
*A43B 5/02* (2006.01)

(52) U.S. Cl.
CPC ..... *A43B 5/025* (2013.01); *A43B 23/021* (2013.01); *A43B 23/0205* (2013.01); *A43B 23/025* (2013.01); *A43B 23/027* (2013.01); *A43B 23/0235* (2013.01); *A43B 23/0255* (2013.01); *A43B 23/0275* (2013.01)

(58) Field of Classification Search
None
See application file for complete search history.

(56) References Cited

U.S. PATENT DOCUMENTS 1,339,462 A 5/1920 Lionne
1,677,370 A 7/1928 Roewade
(Continued)

FOREIGN PATENT DOCUMENTS

CN 2162110 Y 4/1994
CN 101179958 A 5/2008
(Continued)

OTHER PUBLICATIONS

State Intellectual Property Office, Chinese Office Action for Application No. 201480010302.5, dated Mar. 8, 2017 (6 pages).
(Continued)

*Primary Examiner* — Jila M Mohandesi
(74) *Attorney, Agent, or Firm* — Honigman LLP; Matthew H. Szalach; Jonathan O'Brien

(57) ABSTRACT

An article of footwear is provided, which may include an upper and a sole structure. The upper may include an exposed outer layer forming at least a portion of an external surface of the upper. The upper may also include a polymer foam material selectively located on an inner side of the exposed outer layer and adjacent portions of the exposed outer layer, thereby forming padded portions of the upper. The padded portions of the upper may be located in areas of the article of footwear that correspond with predetermined bones of a foot of a wearer of the article of footwear.

20 Claims, 9 Drawing Sheets

Related U.S. Application Data continuation-in-part of application No. 13/777,230, filed on Feb. 26, 2013, now Pat. No. 10,085,516.

(56) References Cited

U.S. PATENT DOCUMENTS

| | | | | |
|---|---|---|---|---|
| 1,887,725 | A * | 11/1932 | Walsh | A43B 5/02 36/128 |
| 2,034,091 | A | 3/1936 | Dunbar | |
| 2,101,723 | A | 12/1937 | Smith | |
| 2,147,197 | A | 2/1939 | Glidden | |
| 2,158,153 | A | 5/1939 | Roberts | |
| 2,215,340 | A | 9/1940 | Vasen | |
| 2,651,856 | A | 9/1953 | Newton, Jr. | |
| 2,772,489 | A | 12/1956 | Porter | |
| 3,234,667 | A * | 2/1966 | Bovay | A43B 5/025 36/113 |
| 3,310,889 | A * | 3/1967 | Samuels | A43B 5/02 36/72 R |
| 3,769,723 | A | 11/1973 | Masterson et al. | |
| 3,931,685 | A | 1/1976 | Laukaitis | |
| 4,222,183 | A | 9/1980 | Haddox | |
| 4,255,876 | A | 3/1981 | Johnson | |
| 4,265,032 | A | 5/1981 | Levine | |
| 4,447,967 | A | 5/1984 | Zaino et al. | |
| 4,594,283 | A | 6/1986 | Ohigashi | |
| 5,497,564 | A | 3/1996 | Allen et al. | |
| 5,555,650 | A | 9/1996 | Longbottom et al. | |
| 5,709,954 | A | 1/1998 | Lyden et al. | |
| 5,765,296 | A | 6/1998 | Ludemann et al. | |
| 5,950,335 | A | 9/1999 | Okajima | |
| 6,029,376 | A | 2/2000 | Cass | |
| 6,038,792 | A | 3/2000 | Hauter | |
| 6,286,233 | B1 | 9/2001 | Gaither | |
| 6,451,404 | B1 | 9/2002 | Nobuto et al. | |
| 6,499,233 | B1 | 12/2002 | Chenevert | |
| 6,505,424 | B2 | 1/2003 | Oorei et al. | |
| 6,715,218 | B2 | 4/2004 | Johnson | |
| 6,862,820 | B2 | 3/2005 | Farys et al. | |
| 6,910,288 | B2 | 6/2005 | Dua | |
| 6,922,912 | B2 | 8/2005 | Phillips | |
| 6,986,183 | B2 | 1/2006 | Delgorgue et al. | |
| 7,010,872 | B2 * | 3/2006 | Pawlus | A43B 3/0047 36/100 |
| 7,159,340 | B2 | 1/2007 | Borsoi | |
| 7,424,783 | B2 | 9/2008 | Meschter et al. | |
| 7,591,084 | B2 | 9/2009 | Santa Ana | |
| 7,765,718 | B2 | 8/2010 | Wilkenfeld | |
| 7,996,924 | B2 | 8/2011 | Wright et al. | |
| 8,007,890 | B2 | 8/2011 | Yoneda et al. | |
| 8,196,320 | B2 * | 6/2012 | Adami | A43B 5/025 36/100 |
| 8,578,632 | B2 | 11/2013 | Bell et al. | |
| 2003/0159312 | A1 | 8/2003 | Farys et al. | |
| 2004/0128863 | A1 | 7/2004 | Hong et al. | |
| 2004/0181972 | A1 | 9/2004 | Csorba | |
| 2005/0125907 | A1 | 6/2005 | Yamasaki et al. | |
| 2005/0282454 | A1 | 12/2005 | Meschter et al. | |
| 2008/0028635 | A1 | 2/2008 | Park | |
| 2009/0100713 | A1 | 4/2009 | Adami et al. | |
| 2009/0241374 | A1 | 10/2009 | Sato et al. | |
| 2010/0037483 | A1 | 2/2010 | Meschter et al. | |
| 2010/0180469 | A1 | 7/2010 | Baucom et al. | |
| 2010/0251564 | A1 | 10/2010 | Meschter | |
| 2011/0010964 | A1 | 1/2011 | Hardy et al. | |
| 2011/0035963 | A1 | 2/2011 | Baker et al. | |
| 2011/0099848 | A1 | 5/2011 | Tomat et al. | |
| 2011/0119957 | A1 | 5/2011 | Hooper et al. | |
| 2012/0011744 | A1 | 1/2012 | Bell et al. | |
| 2012/0174433 | A1 | 7/2012 | Mahoney | |
| 2012/0246973 | A1 * | 10/2012 | Dua | A43B 23/0275 36/83 |
| 2012/0255201 | A1 | 10/2012 | Little | |
| 2012/0297642 | A1 | 11/2012 | Schaefer et al. | |
| 2012/0297643 | A1 | 11/2012 | Shaffer et al. | |
| 2013/0019508 | A1 | 1/2013 | Smith et al. | |
| 2013/0047471 | A1 | 2/2013 | Liang | |
| 2013/0312284 | A1 * | 11/2013 | Berend | A43B 1/0072 36/84 |
| 2014/0237858 | A1 | 8/2014 | Adami et al. | |
| 2015/0013187 | A1 | 1/2015 | Taniguchi et al. | |

FOREIGN PATENT DOCUMENTS

| | | | |
|---|---|---|---|
| CN | 101909471 | A | 12/2010 |
| CN | 102548442 | A | 7/2012 |
| CN | 103687507 | A | 3/2014 |
| DE | 202010017958 | U1 | 6/2013 |
| EP | 1621089 | A1 | 2/2006 |
| EP | 2484240 | A2 | 8/2012 |
| FR | 2428987 | A1 | 1/1980 |
| GB | 2230174 | A | 10/1990 |
| JP | H05285004 | A | 11/1993 |
| JP | H11093081 | A | 4/1999 |
| JP | 2001192979 | A | 7/2001 |
| JP | 2003171884 | A | 6/2003 |
| WO | WO-9825491 | A1 | 6/1998 |
| WO | WO-2011082391 | A1 | 7/2011 |
| WO | WO-2013019934 | A1 | 2/2013 |
| WO | WO-2014134024 | A1 | 9/2014 |

OTHER PUBLICATIONS

State Intellectual Property Office, Chinese Office Action for Application No. 201480010302.5, dated Jul. 13, 2016 (15 pages).
United States Patent and Trademark Office, Non-final Rejection and List of References Cited by Examiner issued for U.S. Appl. No. 14/269,239, dated Apr. 19, 2017 (9 pages).
State Intellectual Property Office, Chinese Office Action for Application No. 201480010302.5, dated Sep. 18, 2017.
State Intellectual Property Office, Chinese Office Action for Application No. 201580022695.6, dated Nov. 24, 2017.
United States Patent and Trademark Office, Non-final Office Action for U.S. Appl. No. 15/276,466, dated Feb. 28, 2017.
International Preliminary Report on Patentability dated Sep. 11, 2015 for PCT/US2014/018274.
International Search Report and Written Opinion dated Jun. 24, 2014 for PCT/US2014/018274.
Voluntary Amendments filed Jan. 13, 2016 for EP Application No. 14717230.8.
Detailed Observations and Voluntary Amendments filed in Chinese Application No. 201480010302.5 dated Mar. 8, 2016.
International Search Report and Written Opinion dated Aug. 4, 2015 for PCT/US2015/025906.
Office Action for Chinese Application No. 201480010302.5 dated Jul. 13, 2016.
United States Patent and Trademark Office, Final Office Action for U.S. Appl. No. 15/276,466, dated Jul. 31, 2018.
United States Patent and Trademark Office, Non-final Office Action for U.S. Appl. No. 15/276,466, dated Feb. 6, 2018.
United States Patent and Trademark Office, Final Office Action for U.S. Appl. No. 15/276,466, dated Aug. 4, 2017.
United States Patent and Trademark Office, Non-final Office Action for U.S. Appl. No. 13/777,230, dated Oct. 2, 2017.
United States Patent and Trademark Office, Final Office Action for U.S. Appl. No. 13/777,230, dated Apr. 13, 2017.
United States Patent and Trademark Office, Non-final Office Action for U.S. Appl. No. 13/777,230, dated Nov. 3, 2016.
United States Patent and Trademark Office, Final Office Action for U.S. Appl. No. 13/777,230, dated Jun. 20, 2016.
United States Patent and Trademark Office, Non-Final Office Action for U.S. Appl. No. 13/777,230, dated Feb. 1, 2016.
United States Patent and Trademark Office, Non-Final Office Action for U.S. Appl. No. 14/269,239, dated Feb. 20, 2018.
United States Patent and Trademark Office, Non-Final Office Action for U.S. Appl. No. 14/269,239, dated Sep. 14, 2017.
United States Patent and Trademark Office, Non-Final Office Action for U.S. Appl. No. 14/269,239, dated Apr. 19, 2017.

(56) References Cited

OTHER PUBLICATIONS

United States Patent and Trademark Office, Non-Final Office Action for U.S. Appl. No. 14/269,239, dated Dec. 5, 2016.
United States Patent and Trademark Office, Non-Final Office Action for U.S. Appl. No. 14/269,239, dated Sep. 16, 2016.

* cited by examiner

FOOTWEAR UPPER HAVING SELECTIVELY LOCATED PADDING

CROSS-REFERENCE TO RELATED APPLICATIONS

This application is a continuation of U.S. patent application Ser. No. 14/269,239, filed May 5, 2014, which is a continuation-in-part of U.S. patent application Ser. No. 13/777,230, filed Feb. 26, 2013 (now U.S. Pat. No. 10,085,516, issued Oct. 2, 2018), entitled "Article of Footwear with Reinforced Elastic Upper," the entire disclosure of which is incorporated herein by reference.

BACKGROUND

The present disclosure is directed to an article of footwear and, more particularly, to an article of footwear having an upper with selectively located padding.

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces (that is, providing cushioning) during walking, running, and other ambulatory activities, the sole structure may influence foot motions (for example, by resisting pronation), impart stability, and provide traction, for example. Accordingly, the upper and the sole structure operate cooperatively to provide a comfortable structure that is suited for a wide variety of athletic activities.

The upper is often formed from a plurality of material elements (for example, textiles, polymer sheets, foam layers, leather, and synthetic leather) that are stitched or adhesively bonded together to define a void or cavity on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permit entry and removal of the foot from the void within the upper. In addition, the upper may include a tongue that extends under the lacing system to enhance adjustability and comfort of the footwear, and the upper may incorporate a heel counter or other stabilizing structure.

The upper may also include provisions to improve performance, fit, comfort, protection, and durability. Materials selection and placement may be utilized to achieve certain desired characteristics.

SUMMARY

In some embodiments, an article of footwear may have an upper that includes features that provide protection and durability. For example, in some embodiments, the upper may be formed of a thin, elastic skin and foam padding that is selectively placed in various portions of the upper. The padding may be disposed in portions of the upper that correspond with predetermined portions of the foot. The selective placement of the padding may provide protection for certain portions of the foot, as well as increased strength and durability for the padded portions of the upper. The unpadded portions of the upper, may have a reduced thickness, and thus, may provide increased feel (e.g., of a soccer ball) and reduced weight.

In one aspect, the present disclosure is directed to an article of footwear including a sole structure fixedly attached to an upper configured to receive a foot of a wearer. The upper may include an exposed outer layer forming at least a portion of an external surface of the upper. The upper may also include a polymer foam material selectively located on an inner side of the exposed outer layer and adjacent portions of the exposed outer layer, thereby forming padded portions of the upper. The padded portions of the upper may be located in areas of the article of footwear that correspond with predetermined bones of a foot of a wearer of the article of footwear.

In another aspect, the present disclosure is directed to an article of footwear including a sole structure fixedly attached to an upper configured to receive a foot of a wearer. The upper may include an exposed outer layer forming at least a portion of an external surface of the upper. The upper may also include padded portions and unpadded portions, wherein the padded portions of the upper include a polymer foam material selectively located on an inner side of the exposed outer layer and adjacent portions of the exposed outer layer. The padded portions of the upper may be located in areas of the article of footwear that correspond with distal phalanges of a foot of a wearer of the article of footwear. The unpadded portions of the upper may be located in areas of the article of footwear that correspond with proximal phalanges of the foot of the wearer.

In another aspect, the present disclosure is directed to an article of footwear including a sole structure fixedly attached to an upper configured to receive a foot of a wearer. The upper may include an exposed outer layer forming at least a portion of an external surface of the upper. The upper may also include padded portions and unpadded portions, wherein the padded portions of the upper include a polymer foam material selectively located on an inner side of the exposed outer layer and adjacent portions of the exposed outer layer. At least one of the unpadded portions of the upper may include one or more transparent portions.

Other systems, methods, features and advantages of the current embodiments will be, or will become, apparent to one of ordinary skill in the art upon examination of the following figures and detailed description. It is intended that all such additional systems, methods, features and advantages be included within this description and this summary, be within the scope of the current embodiments, and be protected by the following claims.

BRIEF DESCRIPTION OF THE DRAWINGS

The current embodiments can be better understood with reference to the following drawings and description. The drawings are schematic. Accordingly, the components in the figures are not necessarily to scale, with emphasis instead being placed upon illustrating the principles of the current embodiments. Moreover, in the figures, like reference numerals designate corresponding parts throughout the different views.

DETAILED DESCRIPTION

The following discussion and accompanying figures disclose a sole structure for an article of footwear. Concepts associated with the footwear disclosed herein may be applied to a variety of athletic footwear types, including soccer shoes, running shoes, baseball shoes, basketball shoes, cross-training shoes, cycling shoes, football shoes, golf shoes, tennis shoes, walking shoes, and hiking shoes and boots, for example. The concepts may also be applied to footwear types that are generally considered to be non-athletic, including dress shoes, loafers, sandals, and work boots. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure. In some cases, the longitudinal direction may extend from a forefoot portion to a heel portion of the sole. Also, the term "lateral," as used throughout this detailed description and in the claims, refers to a direction extending a width of a sole. In other words, the lateral direction may extend between a medial side and a lateral side of footwear, with the lateral side of footwear being the surface that faces away from the other foot, and the medial side being the surface that faces toward the other foot.

Furthermore, the term "vertical," as used throughout this detailed description and in the claims, refers to a direction generally perpendicular to a lateral and longitudinal direction. For example, in cases where a sole is placed flat on a ground surface, the vertical direction may extend from the ground surface upward. It will be understood that each of these directional adjectives may be applied to individual components of the footwear. In addition, the terms "upward" and "downward," as used throughout this detailed description and the claims, refer to substantially vertical directions. For example, the term "upwards" refers to the vertical direction heading away from a ground surface, while the term "downwards" refers to the vertical direction heading towards the ground surface.

For purposes of this disclosure, the term fixedly attached shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques.

Figure 1:
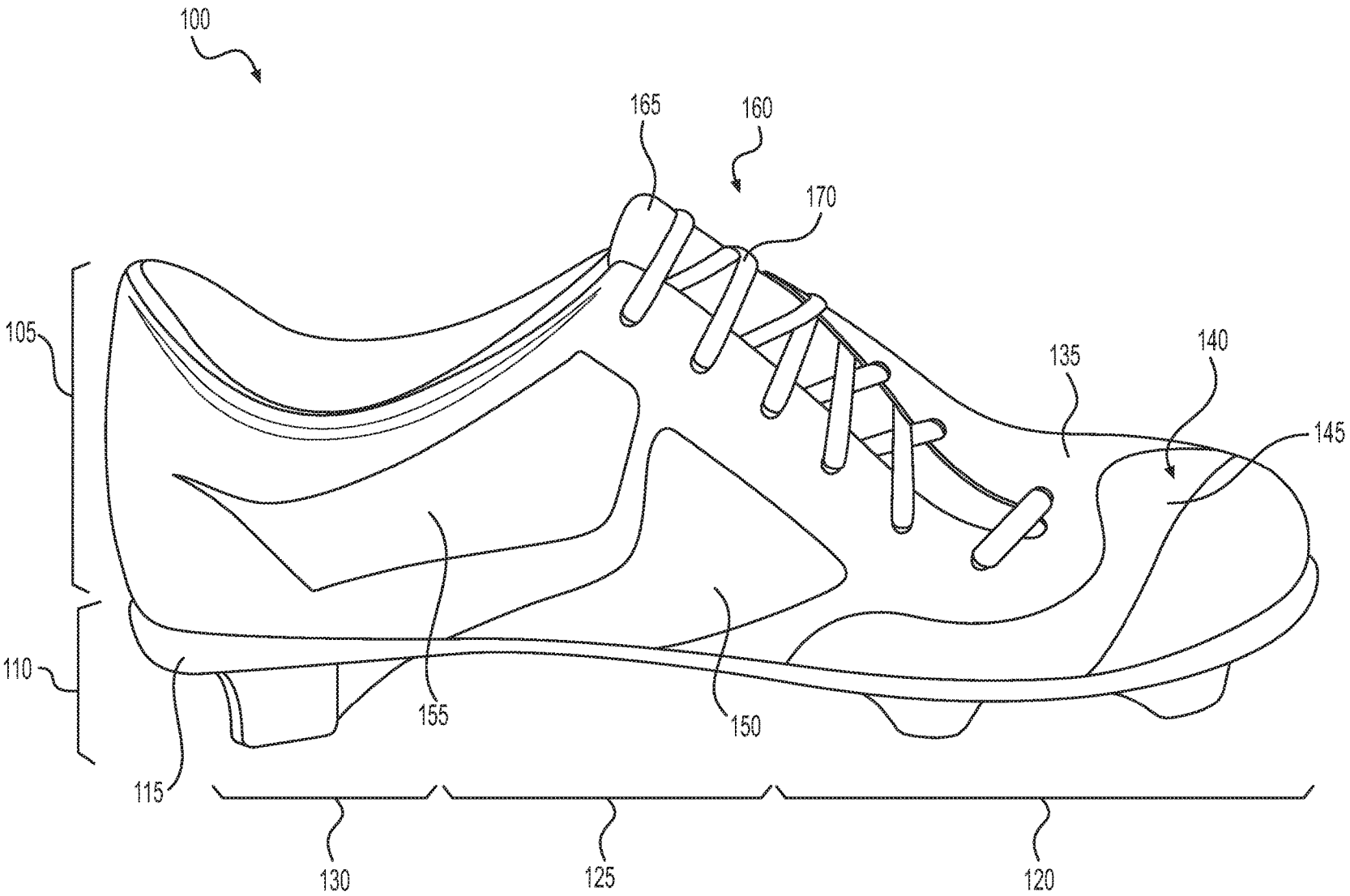
FIG. 1 is a schematic illustration of an embodiment of an article of footwear having an upper formed of an exposed outer layer and including selectively placed internal padding.

FIG. 1 depicts an embodiment of an article of footwear 100, which may include an upper 105 and a sole structure 110 secured to upper 105. Sole structure 110 may include an outer member 115 and may be fixedly attached to upper 105. For reference purposes, footwear 100 may be divided into three general regions: a forefoot region 120, a midfoot region 125, and a heel region 130. Forefoot region 120 generally includes portions of footwear 100 corresponding with the toes and the joints connecting the metatarsals with the phalanges. Midfoot region 125 generally includes portions of footwear 100 corresponding with an arch area of the foot. Heel region 130 generally corresponds with rear portions of the foot, including the calcaneus bone. Forefoot region 120, midfoot region 125, and heel region 130 are not intended to demarcate precise areas of footwear 100. Rather, forefoot region 120, midfoot region 125, and heel region 130 are intended to represent general relative areas of footwear 100 to aid in the following discussion. Since sole structure 110 and upper 105 both span substantially the entire length of footwear 100, the terms forefoot region 120, midfoot region 125, and heel region 130 apply not only to footwear 100 in general, but also to sole structure 110 and upper 105, as well as the individual elements of sole structure 110 and upper 105.

The disclosed footwear components may be formed of any suitable materials. In some embodiments, one or more materials disclosed in Lyden et al. (U.S. Pat. No. 5,709,954), which is hereby incorporated by reference in its entirety, may be used.

Sole structure 110 may be fixedly attached to upper 105 (for example, with adhesive, stitching, welding, and/or other suitable techniques) and may have a configuration that extends between upper 105 and the ground. Sole structure 110 may include provisions for attenuating ground reaction forces (that is, cushioning the foot). In addition, sole structure 110 may be configured to provide traction, impart stability, and/or limit various foot motions, such as pronation, supination, and/or other motions.

The configuration of sole structure 110 may vary significantly according to one or more types of ground surfaces on which sole structure 12 may be used, for example, natural turf, synthetic turf, dirt, pavement (for example, asphalt, concrete, and other types of pavement), as well as indoor surfaces, such as hardwood, synthetic rubber surfaces, tile, and other indoor surfaces. In addition, the configuration of sole structure 110 may vary significantly according to the type of activity for which footwear 100 is anticipated to be used (for example, running, walking, soccer, baseball, basketball, and other activities). Footwear 100 is depicted in the accompanying figures as a cleated shoe, having a sole structure suited for natural and/or synthetic turf. Although footwear 100, as depicted, may be suited for soccer, such a cleated shoe may be applicable for use in other activities on natural and/or synthetic turf, such as baseball, football, and other such activities where traction and grip may be enhanced by cleat members. However, many of the features of footwear 100 discussed herein may be applicable to other types of footwear, including non-cleated footwear.

In some embodiments, sole structure 110 may include multiple components, which may individually and/or collectively provide footwear 110 with a number of attributes, such as support, rigidity, flexibility, stability, cushioning, comfort, reduced weight, traction, and/or other attributes. Outer member 115 of sole structure 110 may be formed of suitable materials for achieving the desired performance attributes. Sole component may be formed of any suitable polymer, composite, and/or metal alloy materials. Exemplary such materials may include thermoplastic and thermoset polyurethane, polyester, nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In some embodiments, outer member 115 may be fashioned from a durable and wear-resistant material (for example, rubber). Other suitable materials will be recognized by those having skill in the art.

Outer member 115 may include a ground engaging lower surface configured to engage the ground. Accordingly, outer member 115 may include one or more ground engaging members extending from the lower surface and configured to provide traction. It will be understood that any type of ground-engaging members could be used with sole structure 110. In some cases, ground-engaging members could be configured to engage a soft ground surface. For example, in one embodiment, ground-engaging members may be configured to engage a soft grass surface. In other cases, ground-engaging members could be configured to engage a hard surface. For example, in one embodiment ground-engaging members could be configured to engage a hard grass surface or artificial turf. In still other embodiments, any other types of ground-engaging members could be used.

Sole structure 110 may also include other components, such as an insole (sockliner), midsole, and/or chassis plate. The insole may be a thin, compressible member located (in some cases removably) within the upper and adjacent to a plantar (that is, lower) surface of the foot to provide comfort, support, and stability. The midsole may be secured to a lower surface of the upper and may form a middle layer of the sole structure. Many midsole configurations are primarily formed from a resilient polymer foam material, such as polyurethane (PU) or ethyl vinyl acetate (EVA) that extends throughout the length and width of the footwear. The midsole may also incorporate plates, moderators, fluid-filled chambers, and/or other elements that further attenuate forces, influence the motions of the foot, and/or impart stability, for example.

Selection and configuration of the insole, midsole, and chassis plate may be based on the activity and athlete for which article of footwear 100 is configured. In some cases, one or more such components may be omitted from sole structure 110. For example, an article of footwear configured for soccer may omit a midsole. In some embodiments, a chassis plate may be incorporated into outer member 115. In addition, for soccer configurations, a minimalist insole may be implemented in order to save weight, and provide a low-to-the ground stance, which is desirable for a soccer shoe.

Upper 105 may include one or more material elements (for example, textiles, foam, leather, and synthetic leather), which may be stitched, adhesively bonded, molded, or otherwise formed to define an interior cavity configured to receive a foot. The material elements may be selected and arranged to selectively impart properties such as durability, air-permeability, wear-resistance, flexibility, and comfort.

In sports like soccer, there is a desire to provide the upper with a relatively thin structure in order to provide increased feel when controlling a soccer ball by contacting the ball with the foot. However, it may be desirable to not only provide ball feel, but also protection for the foot against, for example, being stepped on, or kicked by, another player. In addition, it may also be desirable to provide reinforcement for such a thin upper. While adding material to the upper may provide protection and reinforcement, it may reduce ball feel, as it may increase thickness of the upper. Further, adding material may increase the weight of an article of footwear. Accordingly, in order to provide protection and reinforcement, while maintaining a high level of ball feel and minimizing weight, material may be added to the upper in select locations that are desired to be protected or reinforced, while omitting such additional material from other portions of the upper.

In some embodiments, the upper may include an exposed outer layer. The outer layer may be formed of a substantially elastic material, which may conform to the contours of the foot of a wearer. In addition, the upper may include selectively placed padding, defining padded portions and unpadded portions of the upper. The padded portions may be located in areas of the upper that correspond with predetermined anatomical features of the foot. For example, in some embodiments, the padded portions may be located in an area that corresponds with the distal phalanges of the foot. In some embodiments including padded portions corresponding with the distal phalanges, unpadded portions may correspond with the proximal phalanges. Also, in some embodiments, the padded portions may include padding located in the heel region of the footwear, around the collar of the opening configured to receive the foot, in a lace region of the footwear, and in select portions of the medial or lateral sides of the footwear. The locations in which padding is incorporated into the upper may be varied according to the athletic activity for which the footwear is intended.

In some embodiments, upper 105 may include one or more padded portions 135. Padded portions 135 may further define one or more unpadded portions 140. Unpadded portions may include a first unpadded portion 145, which may be disposed in a toe region of footwear 100. In some embodiments, upper 105 may also include a second unpadded portion 150 and a third unpadded portion 155 which may be disposed on a side portion of upper 105. For example, as shown in FIG. 1, second unpadded portion 150 and third unpadded portion 155 may be located on a lateral side of footwear 100. Further, in some embodiments, padded portions 135 may also be included in a lace region 160 of footwear 100. For example, a tongue 165 may include padding beneath a lace 170.

Figure 2:
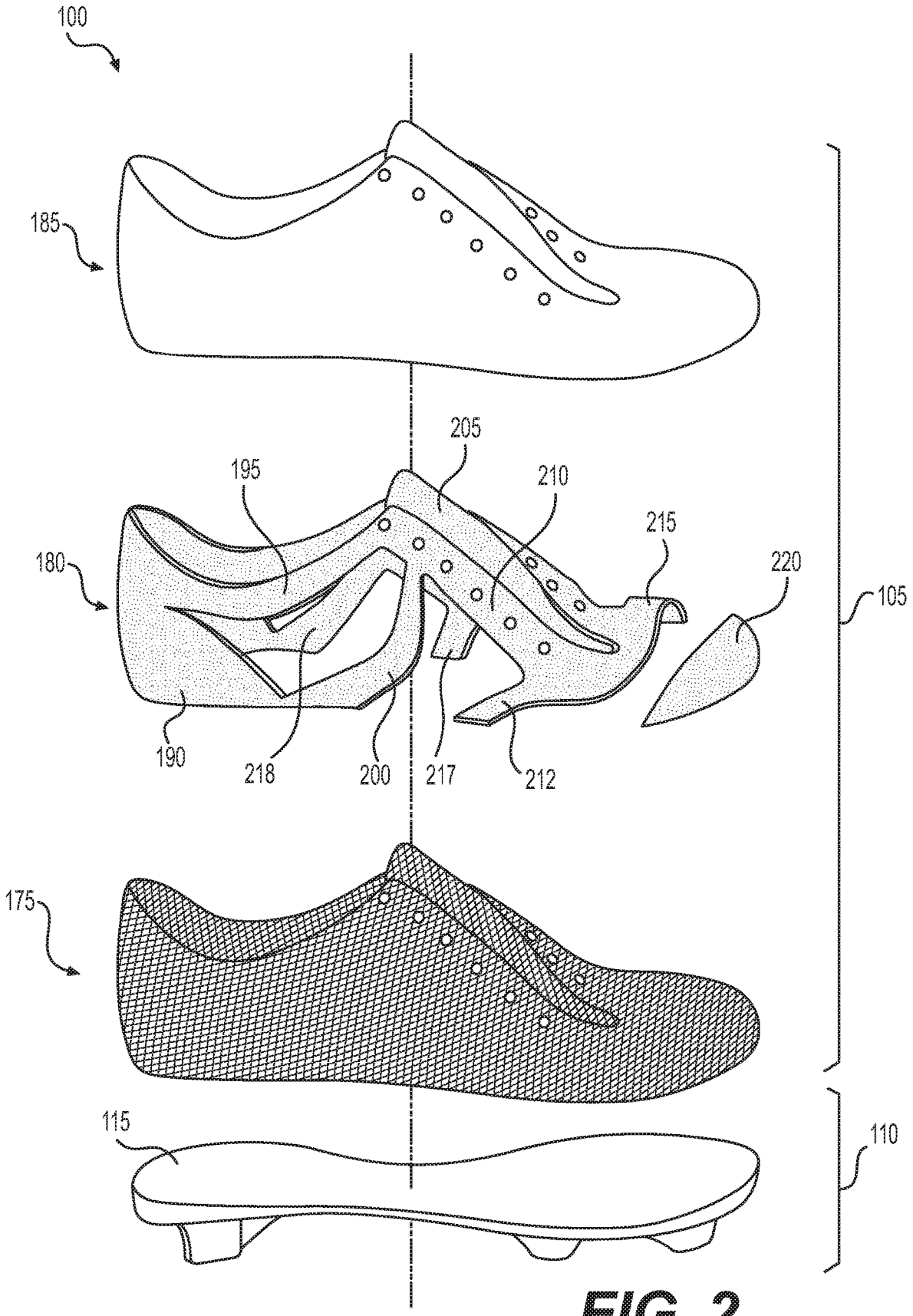
FIG. 2 is a schematic exploded view of the article of footwear shown in FIG. 1.

FIG. 2 is a schematic exploded view of the article of footwear shown in FIG. 1, showing the various layers of upper 105. For example, in some embodiments, upper 105 may include an exposed outer layer 185 forming at least a portion of an external surface of upper 105. In addition, upper 105 may include a padding layer 180, as shown in FIG. 2. Padding layer 180 may be disposed internal to outer layer 185. Padding layer 180 may be disposed adjacent portions of exposed outer layer 185, thereby forming padded portions of upper 105. In addition, upper 105 may include an inner lining material layer 175. Lining material layer 175 may be disposed internal to outer layer 185 and internal to padding layer 180. That is, in some embodiments, padding layer 180 may be disposed between outer layer 185 and lining material layer 175.

Any suitable method may be used to secure lining material layer 175, padding layer 180, and outer layer 185 together to form upper 105. For example, stitching, adhesive, welding, or any other suitable joining technique may be used. It will also be noted that additional layers may be included in footwear 100, although none are shown. For example, waterproof or windproof layers, additional foam layers, additional reinforcing materials, and/or additional liner material may be included. Such layers may be full length or partial length.

In some embodiments, the padding material of padding layer 180 may be layered with, but not attached to, outer layer 185 and lining material layer 175. In other embodiments, the padding material may be attached, at least partially, to other components of the footwear. In some embodiments, the reinforcing material may be attached to outer layer 185, for example, by stitching, adhesive, bonding, welding, or any other suitable attachment method. In some embodiments, the padding material may be attached in only select areas to outer layer 185. For example, a strip of padding material may be attached to outer layer 185 only at the ends of the strip, leaving the middle portion of the strip disconnected from outer layer 185. This may provide the upper with greater flexibility to conform to the shape of the foot, while maintaining the strength benefits of the reinforcing material.

Lining material layer 175 may include any material suitable for providing an inner lining of upper 105. In some embodiments, lining material layer 175 may provide moisture management properties. In some embodiments, lining material layer 175 may be formed of a moisture absorbent material. In such embodiments, lining material layer 175 may be configured to wick sweat away from a wearer's foot. In other embodiments, lining material layer 175 may be water repellant, so as to prevent liner 440 from becoming water-logged.

In addition, lining material layer 175 may provide a smooth, and relatively non-abrasive surface configured to contact the foot (or sock) of the wearer. In some embodiments, lining material layer 175 may be formed of leather or synthetic leather. For example, in some embodiments, lining material layer 175 may include a synthetic leather such as Lorica, or a relatively thin elastic nylon.

Exposed outer layer 185 may be formed of any material suitable for use as an outer layer of footwear 100. In some embodiments, outer layer 185 may be formed of a relatively thin material. In some embodiments, outer layer 185 may be formed of a natural materials, such as leather, or synthetic materials. In addition, in some embodiments, outer layer 185 may be formed of a substantially elastic material. For example, in some embodiments, outer layer 185 may be formed of a stretchable polyurethane. In some embodiments, outer layer 185 may be formed of a synthetic leather, such as Clarino. Further, exemplary elastic materials suitable for use in the disclosed embodiments may include latex, Spandex or elastane (which is often sold under the trademark LYCRA®), and/or any other suitable elastic materials.

The elastic material may provide improved fit and comfort. Incorporation of the elastic material enables a close-fitting article of footwear to remain comfortable. In some athletic activities, such as soccer, a particularly close-fitting upper is desirable. For example, while some athletic shoes are desired to fit with a small amount of space (for example ⅜ to ½ inch) between the wearer's toes and the inside front of the cavity within the upper, soccer shoes are desired to fit with no space or virtually no space between the toes and the inside front of the upper. Any extra length of a soccer shoe will tend to catch on the ground when attempting to kick a soccer ball. In addition, a soccer shoe is desired to fit closely around the top and sides of the shoe, to prevent the foot from sliding around inside the shoe, and thereby provide a predictable outer surface which will contact the ball. Further, a relatively thin upper material is also desirable for a soccer shoe in order to provide feel of the ball as well as reduced weight. Thus, in order to provide a close-fitting, thin upper, that is comfortable and high performing, an elastic material may be used in the upper.

In some embodiments, upper 105 may include an elastic skin material forming at least a portion of an external surface of upper 105. Because upper 105 may include elastic skin material, for a given standard shoe size, the cavity defined by upper 105, and configured to receive the foot of a wearer, may be formed to have a volume smaller than the volume of the majority of wearer's feet having the given standard shoe size. For example, in some embodiments, for a given standard shoe size, the cavity may have a volume that is smaller than approximately 90 percent of wearer's feet having the given standard shoe size. In other embodiments, the percentage of wearer's feet that the cavity has a smaller volume than may vary, and thus, may be more or less than 90 percent.

Having a smaller internal cavity, upper 105 may have a stretch-to-fit configuration. That is, upper 105 (or portions of upper 105) may expand when inserting the foot into footwear 100. The result is an upper that fits much like a sock, conforming to virtually all of the contours of the foot. In addition, because the stretch-to-fit configuration includes an upper that fits the foot in a stretched manner, this configuration provides an elastic binding of the upper against the foot, by virtue of the upper's elastic bias. Accordingly, in some embodiments, such an upper may be provided without a closure mechanism (for example, laces, straps, or other closure systems). Further, exposed outer layer 185 may be formed using any of the configurations and materials disclosed in Adami et al., U.S. Pat. No. 10,085,516, issued Oct. 2, 2018 (now U.S. patent application Ser. No. 13/777,230, filed Feb. 26, 2013), entitled "Article of Footwear with Reinforced Elastic Upper," the entire disclosure of which is incorporated herein by reference.

Padding layer 180 may be formed of any material suitable for providing protection to the foot of a wearer and, in some embodiments, reinforcement of upper 105. In some embodiments, padding layer 180 may be formed of a foam material. For example, one or more portions of padding layer 180 may be formed of a polymer foam material. In some embodiments, padding layer 180 may include a substantially incompressible foam material. Although substantially incompressible, such material may be flexible, in order to conform to the contours of the foot. In some embodiments, padding layer 180 may include a substantially compressible material. Such compressible material may also be flexible. Both compressibility and flexibility may enable the foam material to conform to the foot. In some embodiments, padding layer 180 may be formed of a material with minimal elasticity. For example, in some embodiments, padding layer 180 may be relatively inelastic, which may provide support and stability to the foot of the wearer, and may provide reinforcement to upper 105. In some embodiments, padding layer 180 may be formed of a thin, lightweight foam material manufactured by PebaxFoam. In some embodiments, materials other than foams may be used in padding layer 180.

In addition to the performance characteristics of the materials used for padding layer 180, the placement of the padding of padding layer 180 may be selected to provide protection and/or reinforcement in various areas of upper 105. As shown in FIG. 2, padding layer 180 may include padding selectively located in various portions of upper 105. For example, padding layer 180 may include heel cup padding 190. Heel cup padding 190 may provide support, stability, and protection to the heel area of the foot. In some embodiments, heel cup padding 190 may be formed of a substantially rigid material. Padding layer 180 may include collar padding 195, which may be disposed proximate to the throat of footwear 100, that is, the opening into which the foot of a wearer may be received. Collar padding 195 may provide protection and reinforcement around the ankle, as well as comfort and improved fit about the ankle.

In some embodiments, padding layer 180 may include one or more skeletal ribs, which may provide substantially directional reinforcement to upper 105. For example, in some embodiments, padding layer 180 may include a first rib padding 200, a second rib padding 212, a third rib padding 215, a fourth rib padding 217, and a fifth rib padding 218. In the lacing region, padding layer 180 may include padding about the tongue opening proximate the eyelets through which the lace is threaded. For example, padding layer 180 may include an eyelet region padding 210. Eyelet region padding 210 may be formed in a substantially U-shaped configuration about the tongue opening of upper 105.

In some embodiments, one or more of first rib padding 200, second rib padding 212, third rib padding 215, fourth rib padding 217, and fifth rib padding 218 may connect to eyelet region padding 210. For example, as shown in FIG. 2, first rib padding 200, second rib padding 212, third rib padding 215, fourth rib padding 217, and fifth rib padding 218 may extend from eyelet region padding 210 substantially downward to a bottom edge of upper 105. in some embodiments, first rib padding 200, second rib padding 212, third rib padding 215, fourth rib padding 217, and fifth rib padding 218 may extend to outer member 115 of sole structure 110 (see FIG. 3), thus connecting the reinforcement of eyelet region padding 210 with the robust structure of outer member 115 to provide stability and reinforcement to upper 105. Further, positioned as described above, and shown in FIG. 2, first rib padding 200, second rib padding 212, third rib padding 215, fourth rib padding 217, and fifth rib padding 218 may also provide some degree of protection to the medial side and the lateral side of the foot.

Padding layer 180 may be provided in areas of upper 105 that correspond with portions of the foot that may be susceptible to undesired contact. Such areas may be particular to the athletic activity for which the article of footwear is intended to be used. For example, the feet of soccer players may be inadvertently kicked by an opponent. The severity of the impact of such inadvertent kicks may be increased, when both players are kicking at the ball simultaneously, in which case, the contact is often between the instep portion of one player's foot and the instep portion of the other player's foot. When the two players are kicking in opposite directions, the severity of the impact is increased over situations where only one of the players is kicking. In order to protect the instep portion of the wearer's foot, footwear 100 may include padding in lacing region, such as eyelet region padding 210 and tongue padding 205.

Another type of undesired contact that soccer players' feet are susceptible to is being stepped on by another player who is also wearing a cleated shoe. Portions of the foot that are desired to be protected against this type of unwanted contact include the distal phalanges. Accordingly, in some embodiments, padding layer 180 may include a toe cap padding 220, as shown in FIG. 2.

In some embodiments, the various portions of padding layer 180 may be formed of the same material. In other embodiments, different materials may be used for one or more of the padding components. For example, in some embodiments, a relatively thicker padding may be used for some components and a relatively thinner padding may be used for other components. In addition, in some embodiments, the various padding components described above may be formed as separate components, such as toe cap padding 220, as shown in FIG. 2. In other cases, the components may be formed as a unitary, continuous structure, such as the rib padding strips and eyelet region padding 210.

Figure 3:
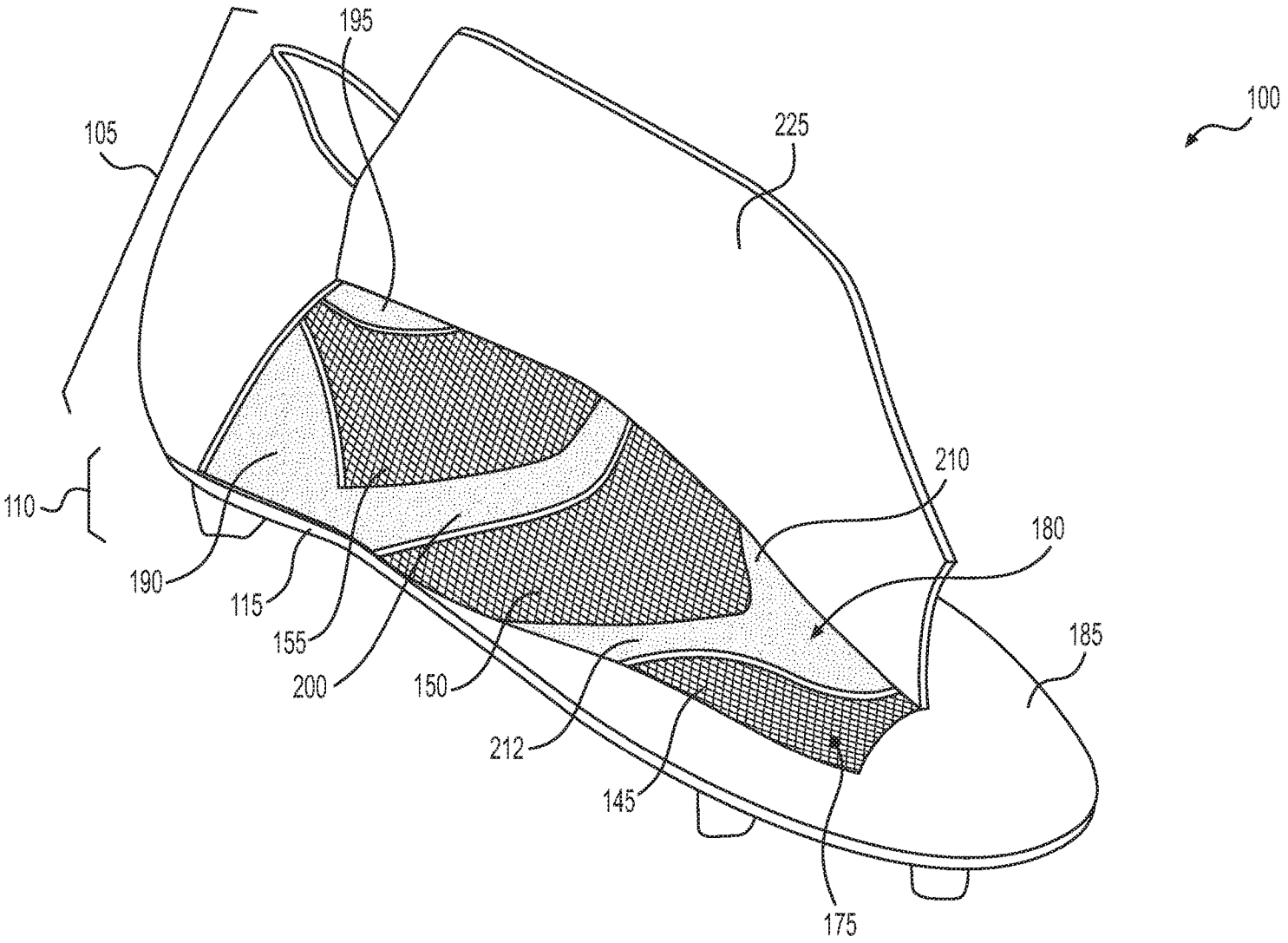
FIG. 3 is a schematic cutaway view of the article of footwear shown in FIG. 1.

FIG. 3 is a cutaway view of footwear 100, with a portion of outer layer 185 peeled back in a flap 225 in order to illustrate the layers of the assembled upper 105. As shown in FIG. 3, padding layer 180 may be disposed between lining material layer 175 and outer layer 185. The padded portions of upper 105, including heel cup padding 190, collar padding 195, first rib padding 200, and second rib padding, may define (between them) unpadded portions of upper 105. For example, first unpadded portion 145 may be bounded by second rib padding 212 and eyelet region padding 210 (as well as toe cap padding 220; see FIG. 4). As also shown in FIG. 3, second unpadded portion 150 may be bounded by first rib padding 200, second rib padding 212, and eyelet region padding 210. Similarly, third unpadded portion 155 may be bounded by heel cup padding 190, collar padding 195, and first rib padding 200.

Figure 4:
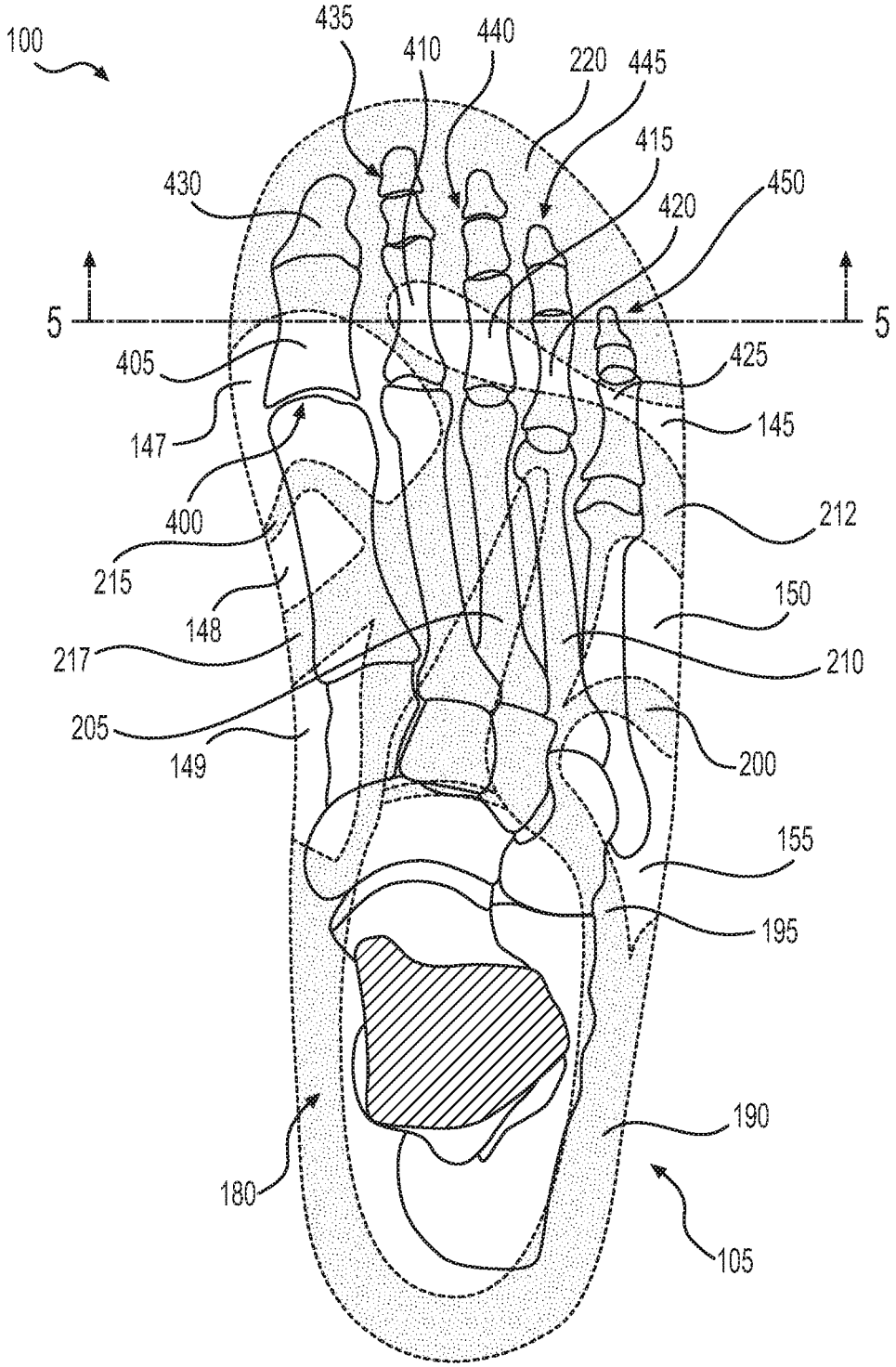
FIG. 4 is a schematic top view of an article of footwear illustrating the arrangement of padded portions of the upper relative to the skeletal structure of the foot of a wearer.

FIG. 4 is a top view of footwear 100 illustrating the arrangement of padded portions of the upper relative to the skeletal structure of the foot of a wearer. In FIG. 4, padding layer 180 is shown with light shading for purposes of illustration. Further, the bones of the foot are shown in solid lines and the boundaries of padding layer 180 are shown in dashed lines as an overlay. Accordingly, padded portions of the upper are shown as shaded and unpadded portions are shown without shading.

In some embodiments, the padded portions of upper 105 are located in areas of the footwear that correspond with predetermined bones of a foot of a wearer. In some cases, the padded portions of the upper may be located in areas of the article of footwear that correspond with distal phalanges. For example, as shown in FIG. 4, toe cap padding 220 may be placed to correspond with the location of distal phalanx 430 of the hallux or first toe, as well as second toe distal phalanges 435, third toe distal phalanges 440, fourth toe distal phalanges 445, and fifth toe distal phalanges 450.

In some embodiments, the unpadded portions of upper 105 may be located in areas that correspond with proximal phalanges of the foot of the wearer. For example, fourth unpadded portion 147 may be located in an area that corresponds with a first proximal phalanx 405 of the hallux (first toe). In addition, first unpadded portion 145 may be located in an area that corresponds with a second proximal phalanx 410 of the second toe, a third proximal phalanx of the third toe, a fourth proximal phalanx 415 of the fourth toe, and a fifth proximal phalanx 450 of the fifth toe. Further, fourth unpadded portion 405 may be located in an area that corresponds with a metatarsophalangeal joint 400 of the hallux.

By omitting padding in first unpadded portion 145 and fourth unpadded portion 147, increased ball feel may be provided in areas of the foot that are used frequently to contact a soccer ball during play. In addition, by omitting padding in first unpadded portion 145 and fourth unpadded portion 147, increased flexibility may be provided to upper 105 in areas in which the foot flexes significantly.

Also shown in FIG. 4, are second unpadded portion 150 and third unpadded portion 155 on a lateral side of upper 105, as well as fifth unpadded portion 148 and sixth unpadded portion 149 on a medial side of upper 105. The lateral and medial unpadded portions may provide weight reduction in areas of the foot not used as frequently to contact the ball and not as likely to be stepped on or kicked. The medial unpadded portions may also provide increased ball feel in an area of the foot that is used frequently to control the soccer ball.

Figure 5:
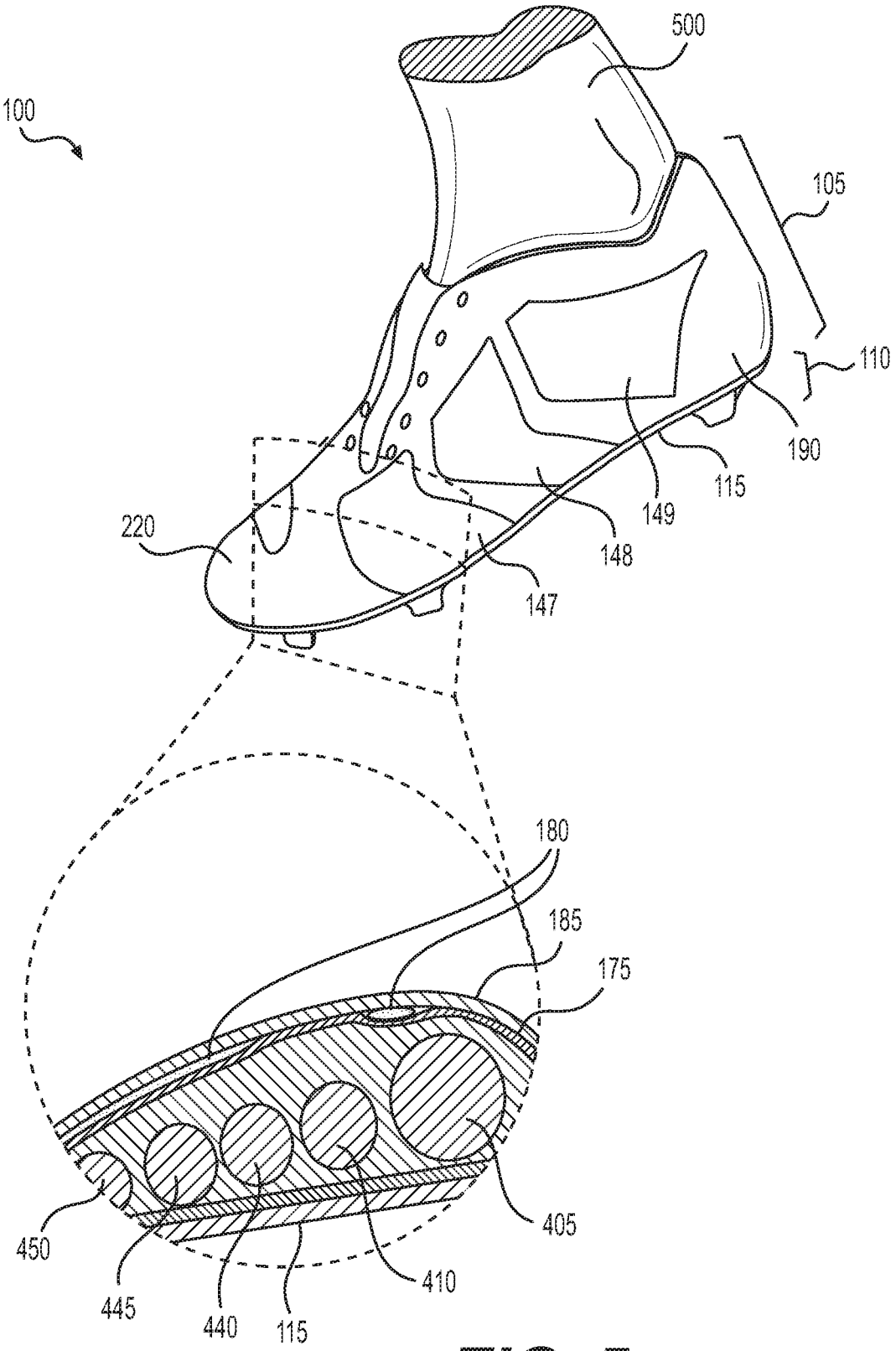
FIG. 5 shows a schematic assembled view of an article of footwear, and also shows an enlarged partial cross-sectional view of a toe region of the article of footwear.

FIG. 5 shows an assembled view of footwear 100, and also shows an enlarged partial cross-sectional view of a toe region of footwear 100 taken generally at section line 5-5 in FIG. 4. As shown in FIG. 5, upper 105 may be unpadded in areas corresponding to first proximal phalanx 405 and second proximal phalanx 410, as illustrated by lining material layer 175 and outer layer 185 abutting one another in these areas. As also shown in FIG. 6, upper 105 may include a portion of padding layer 180 that corresponds with third distal phalanges 440, fourth distal phalanges 445, and fifth distal phalanges 450.

Figure 6:
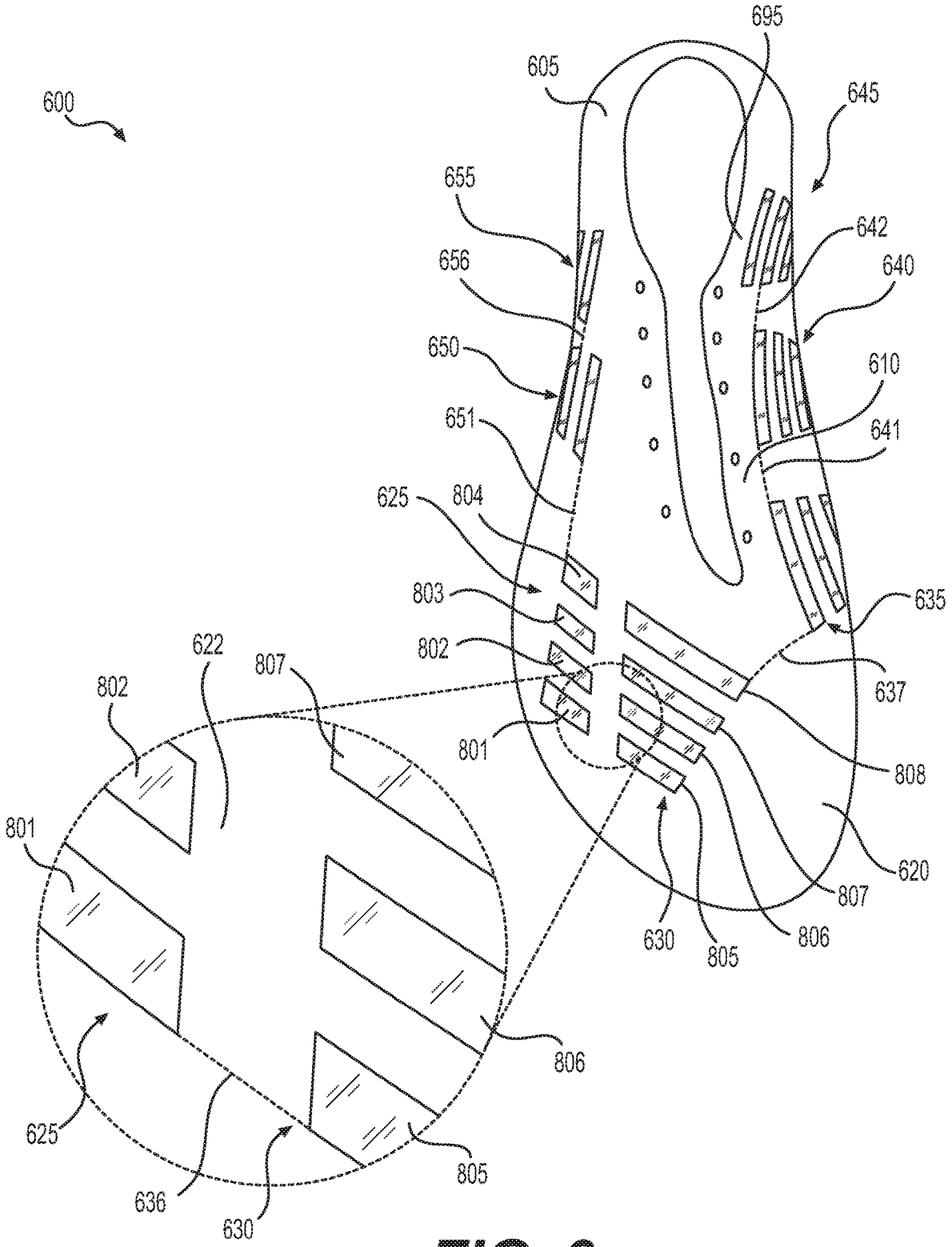
FIG. 6 is a schematic top view of an embodiment of an article of footwear having an upper including a plurality of transparent portions.

FIG. 6 is a top view of an article of footwear 600 according to another embodiment. In some embodiments, footwear 600 may have selectively placed padding similar to the padding discussed above. As shown in FIG. 6, footwear 600 may include an upper 605 having a plurality of transparent portions. In some embodiments, the placement of the transparent portions may coincide with unpadded portions of upper 605.

The substantially transparent portions may have any suitable degree of transparency. In some embodiments, the upper may be transparent all the way through in the substantially transparent portions. This may enable the sock of a wearer to be visible through the upper. In some sports, like soccer, the socks are a part of the uniform, and may be colored with team colors. Accordingly, by providing transparency all the way through the upper, portions of the footwear may appear to have the same color as the wearer's socks, and thus, the same color as the team uniform. This may enable a single style of footwear to be produced to match with teams of all colors, rather than producing several different shoes having differing accent colors. In some embodiments, multiple layers may be substantially transparent in order to provide full transparency through the entire thickness of the upper.

In other embodiments, in the substantially transparent portions, one or more layers of the upper may be transparent, while other layers are not. This partial transparency may expose various internal structures of the upper, such as reinforcing layers, padding, linings, or other structural elements.

As shown in FIG. 6, in some embodiments, upper 605 may include padded regions, such as eyelet region padding 610, collar padding 695, and toe cap padding 620. These padded portions may have similar attributes to those discussed above with regard to corresponding components of other disclosed embodiments.

Disposed between padded portions of upper 605 may be a plurality of unpadded portions. For example, upper 605 may include a first unpadded portion 625. First unpadded portion 625 may be located to correspond with proximal phalanges of the foot. In addition, the area of upper 605 including unpadded portion 625 may include a plurality of substantially transparent portions. For example, as shown in FIG. 6, unpadded portion 625 may include a first plurality of substantially transparent portions including a first substantially transparent portion 801, a second substantially transparent portion 802, a third substantially transparent portion 803, and a fourth substantially transparent portion 804. In some embodiments, the first plurality of substantially transparent portions may be elongate and arranged substantially parallel to one another, as shown in FIG. 6.

Upper 605 may also include a second unpadded portion 630. Second unpadded portion 630 may also correspond with the proximal phalanges of the foot. As shown in FIG. 6, second unpadded portion 630 may include a second plurality of substantially transparent portions, including a fifth substantially transparent portion 805, a sixth substantially transparent portion 806, a seventh substantially transparent portion 807, and an eighth substantially transparent portion 808.

In some embodiments, the second plurality of substantially transparent portions may also be elongate and may be arranged substantially parallel to one another, as shown in FIG. 6. Further, in some embodiments, the first plurality of elongate transparent portions may be aligned with the second plurality of elongate transparent portions. For example, as illustrated in FIG. 6, first substantially transparent portion 801 may be aligned with fifth substantially transparent portion 805, as indicated by a first dashed line 636. In some embodiments, the first plurality of transparent portions may be discontinuous with the second plurality of transparent portions. Further, in some embodiments, a padded strip 622 may be provided between first unpadded portion 625 and second unpadded portion 630.

As shown in FIG. 6, upper 605 may also include a third unpadded portion 635. Third unpadded portion 635 may be provided on a medial side of footwear 600 and may correspond approximately with a first metatarsophalangeal joint of a hallux of the foot. This may provide increased ball feel and reduced weight. Third unpadded portion 635 may include a third plurality of substantially transparent portions similar to the first plurality of substantially transparent portions in first unpadded portion 625 and the second plurality of substantially transparent portions of second unpadded portion 630. As shown in FIG. 6, edges of the third plurality of substantially transparent portions may be substantially aligned with edges of the second plurality of substantially transparent portions, as illustrated by a second dashed line 637.

As shown in FIG. 6, upper 605 may also include a fourth unpadded portion 640. Fourth unpadded portion 640 may also be provided on a medial side of footwear 600. This may provide increased ball feel and reduced weight. Fourth unpadded portion 640 may include a fourth plurality of substantially transparent portions similar to the third plurality of substantially transparent portions in third unpadded portion 635. As shown in FIG. 6, edges of the fourth plurality of substantially transparent portions may be substantially aligned with edges of the third plurality of substantially transparent portions, as illustrated by a third dashed line 641.

Upper 605 may also include a fifth unpadded portion 645. Fifth unpadded portion 645 may also be provided on a medial side of footwear 600. This may provide increased ball feel and reduced weight. Fifth unpadded portion 645 may include a fifth plurality of substantially transparent portions similar to the fourth plurality of substantially transparent portions in fourth unpadded portion 640. As shown in FIG. 6, edges of the fifth plurality of substantially transparent portions may be substantially aligned with edges of the fourth plurality of substantially transparent portions, as illustrated by a fourth dashed line 642.

As shown in FIG. 6, upper 605 may also include a sixth unpadded portion 650. Sixth unpadded portion 650 may be provided on a lateral side of footwear 600. This may provide reduced weight. Sixth unpadded portion 650 may include a sixth plurality of substantially transparent portions similar to the fifth plurality of substantially transparent portions in fifth unpadded portion 645. As shown in FIG. 6, edges of the sixth plurality of substantially transparent portions may be substantially aligned with edges of the first plurality of substantially transparent portions, as illustrated by a fifth dashed line 651.

Upper 605 may also include a seventh unpadded portion 655. Seventh unpadded portion 650 may also be provided on a lateral side of footwear 600. This may provide reduced weight. Seventh unpadded portion 655 may include a seventh plurality of substantially transparent portions similar to the sixth plurality of substantially transparent portions in sixth unpadded portion 650. As shown in FIG. 6, edges of the seventh plurality of substantially transparent portions may be substantially aligned with edges of the sixth plurality of substantially transparent portions, as illustrated by a sixth dashed line 656.

Figure 7:
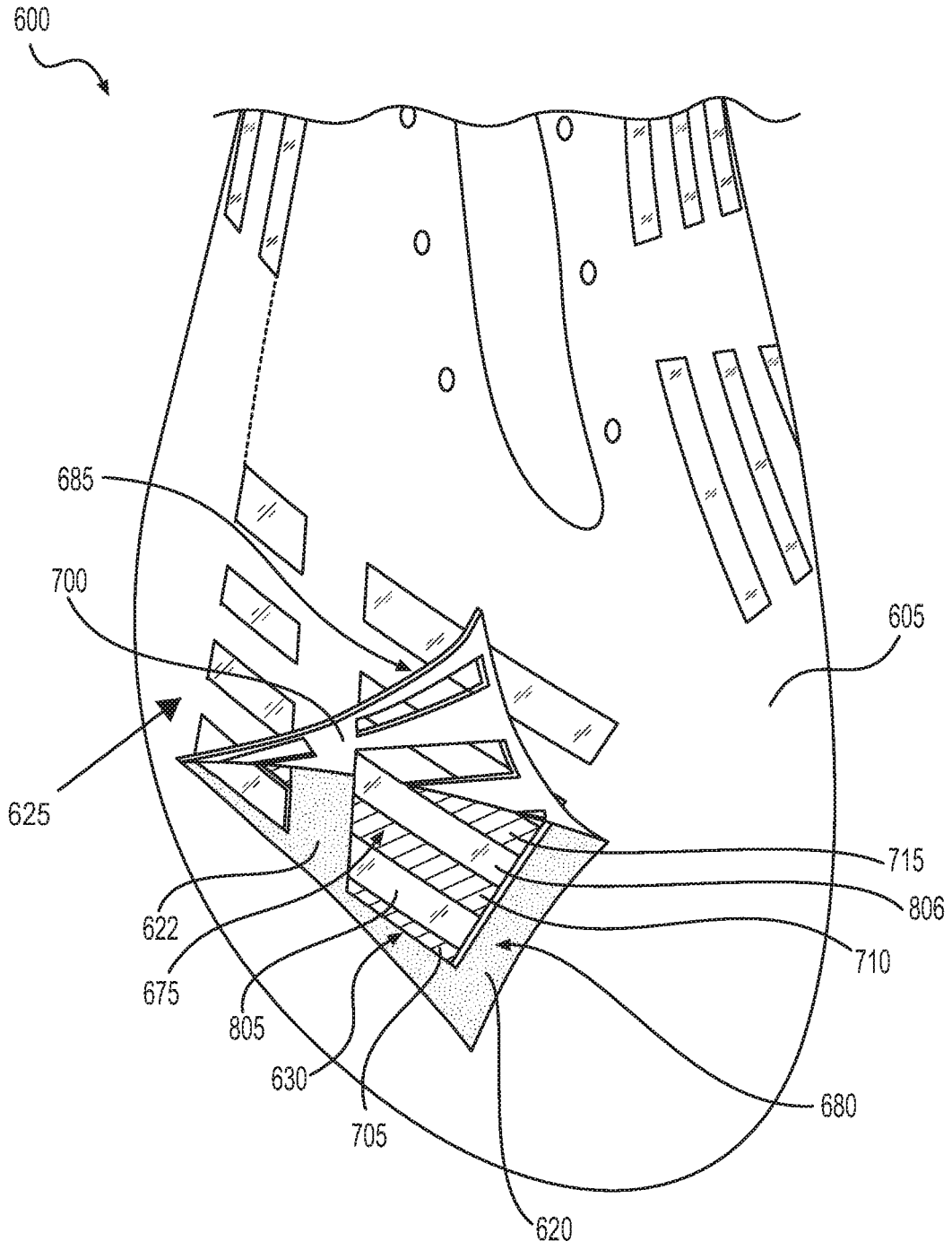
FIG. 7 is a schematic view of the article of footwear shown in FIG. 6, with a peel-away section showing inner layers of the upper.

FIG. 7 is a cutaway view of footwear 600, with a peel-away section showing inner layers of the upper. As shown in FIG. 7, upper 605 may include an exposed outer layer 685. FIG. 7 illustrates a section of outer layer 685 peeled back in a flap 700. Flap 700 exposes internal layers, including a padding layer 680, and a lining material layer 675. Lining material layer 675, padding layer 680, and outer layer 685 may have similar attributes as corresponding components of the embodiments discussed above.

As shown in FIG. 7, toe region padding 620 may extend to an edge of unpadded portion 630. Similarly, padding strip 622 may extend to an opposite edge of unpadded portion 630. In some embodiments, the substantially transparent portions may be transparent completely through the thickness of upper 605. In such embodiments, lining material layer 675 may include either include additional substantially transparent portions, or may simply include openings. Outer layer 685 may be constructed similarly, that is, with transparent portions or openings, as shown in FIG. 7. Further, portions of lining material layer 675 are shown proximate to fifth substantially transparent portion 805 and sixth substantially transparent portion 806. Specifically, a first lining portion 705, a second lining portion 705, and a third lining portion 710 are illustrated among the substantially transparent portions of second unpadded portion 630.

Figure 8:
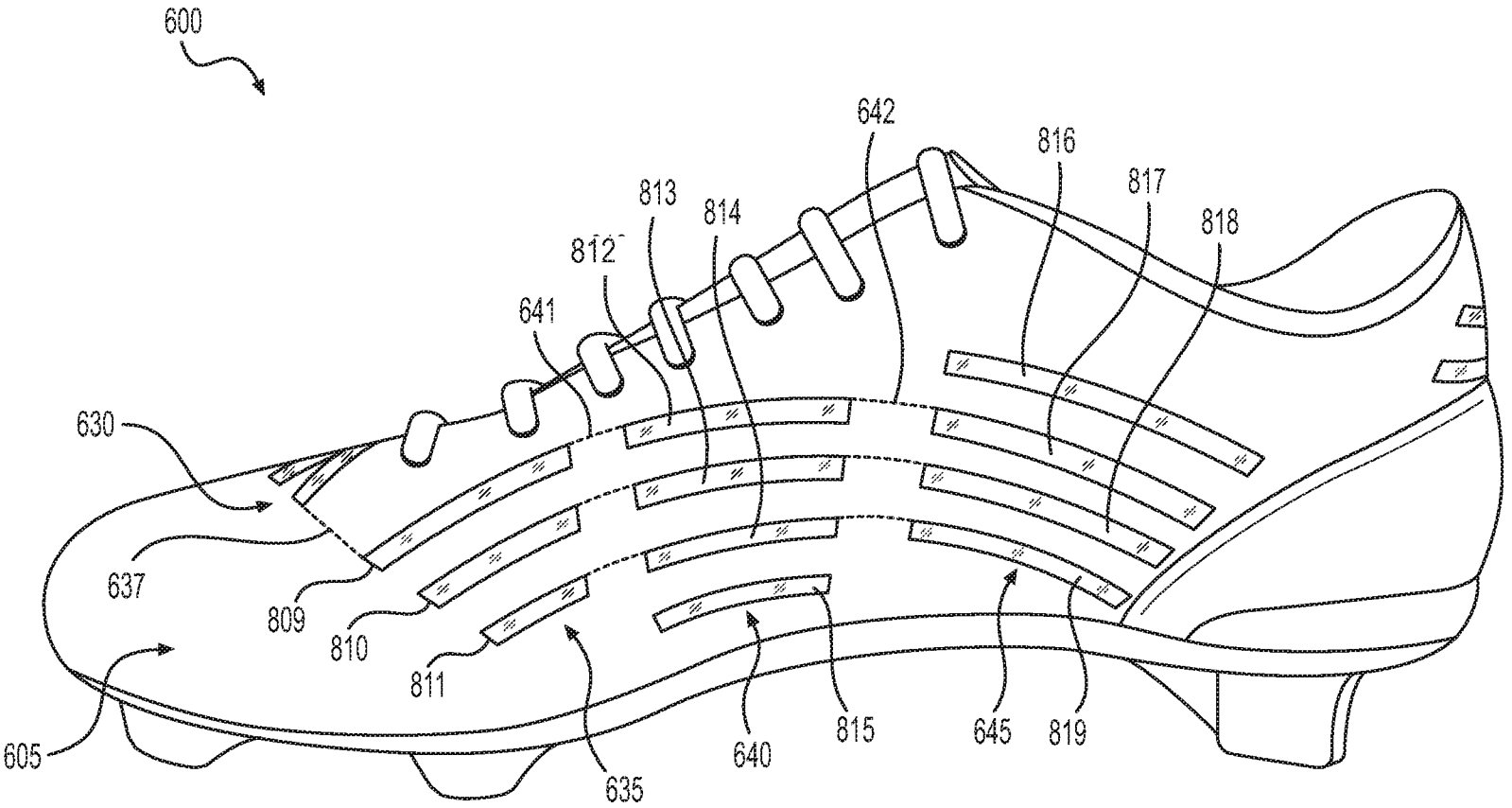
FIG. 8 is a schematic illustration of a medial side view of the article of footwear shown in FIG. 6.

FIG. 8 is a medial side view of footwear 600. FIG. 8 illustrates the arrangement of the medially-located unpadded portions and substantially transparent portions of upper 605. As shown in FIG. 8, third unpadded portion 635 may include a ninth substantially transparent portion 809, a tenth substantially transparent portion 810, and an eleventh substantially transparent portion 811. Second dashed line 637 illustrates the alignment of these transparent portions with those of second unpadded portion 630.

In addition, fourth unpadded portion 640 may include a twelfth substantially transparent portion 812, a thirteenth substantially transparent portion 813, a fourteenth substantially transparent portion 814, and a fifteenth substantially transparent portion 815. It will be noted that the unpadded portions may include varying numbers of substantially transparent portions. Third dashed line 641 illustrates the alignment of ninth substantially transparent portion 809 and twelfth substantially transparent portion 812.

Fifth unpadded portion 645 may include a sixteenth substantially transparent portion 816, a seventeenth substantially transparent portion 817, an eighteenth substantially transparent portion 818, and a nineteenth substantially transparent portion 819. Fourth dashed line 642 illustrates the alignment of twelfth substantially transparent portion 812 and seventeenth substantially transparent portion 817. In some embodiments, one or more substantially transparent portion of an unpadded portion may be unaligned with the substantially transparent portions of an adjacent unpadded portion. For example, fifteenth substantially transparent portion 815 is not aligned with any other substantially transparent portions of adjacent unpadded portions. In some cases, this may be because the adjacent unpadded portion has fewer substantially transparent portions, as with third unpadded portion 635. In some cases this may be because the substantially transparent portions of the adjacent unpadded portion are positioned offset, as with fifth unpadded portion 645. It will also be noted that, in some embodiments, the substantially transparent portions may extend along an arc. Further, in some embodiments, the substantially transparent portions of a given unpadded portion may have varying lengths. For example, the medially-located substantially transparent portions shown in FIG. 8 may have arced and tapered configurations.

Figure 9:
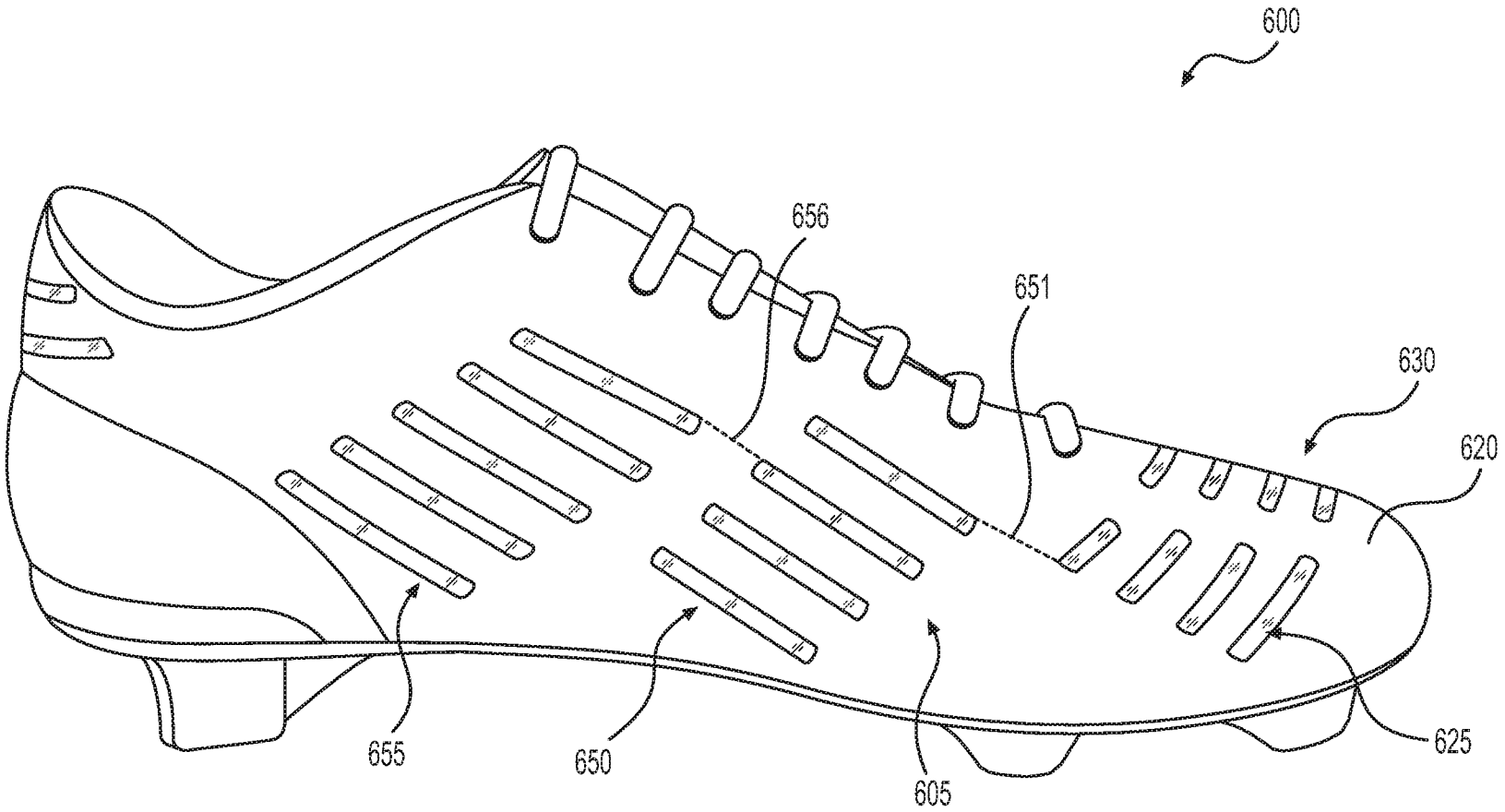
FIG. 9 is a schematic illustration of a lateral side view of the article of footwear shown in FIG. 6.

FIG. 9 is a lateral side view of footwear 600. FIG. 8 illustrates the arrangement of the laterally-located unpadded portions and substantially transparent portions of upper 605. As shown in FIG. 9, in some embodiments, the substantially transparent portions may be substantially linear. As further shown in FIG. 9, in some embodiments, the substantially transparent portions of a given unpadded portion may be staggered, that is, offset from one another along their elongate lengths, as illustrated by the substantially transparent portions of seventh unpadded portion 655.

While various embodiments have been described, the description is intended to be exemplary, rather than limiting and it will be apparent to those in the art that many more embodiments and implementations are possible that are within the scope of the current embodiments. Accordingly, the current embodiments are not to be restricted except in light of the attached claims and their equivalents. Features described in one embodiment may or may not be included in other embodiments described herein. Also, various modifications and changes may be made within the scope of the attached claims.

What is claimed is:

1. An upper for an article of footwear, the upper comprising:

an outer layer forming an external surface of the upper;

a tongue opening terminating at a throat portion located in an area between a medial side and a lateral side of the upper; and a first reinforcing layer disposed within the outer layer and extending continuously from the medial side of the upper to the lateral side of the upper, the first reinforcing layer including (i) a first portion extending from the throat portion along the tongue opening at the medial side, (ii) a second portion extending from the throat portion along the tongue opening at the lateral side, (iii) a first rib portion extending from one of the first portion and the second portion in a direction away from the tongue opening, and (iv) a second rib portion extending from the one of the first portion and the second portion in a direction away from the tongue opening, the second rib portion being separated from the first rib portion to define a gap extending through the first reinforcing layer, and at least one of the first portion and the second portion extending continuously along the tongue opening.

2. The upper of claim 1, wherein the first reinforcing layer includes a third portion that extends along a cuff opening of the upper.

3. The upper of claim 2, wherein the third portion is attached to the first portion at the medial side and is attached to the second portion at the lateral side.

4. The upper of claim 1, wherein the first reinforcing layer extends around a heel region of the upper.

5. The upper of claim 1, wherein the first reinforcing layer extends continuously from the medial side of the upper to the lateral side of the upper at a heel region of the upper.

6. The upper of claim 1, wherein the first portion and the second portion are attached to one another at the throat portion.

7. The upper of claim 1, wherein at least one of the first rib portion and the second rib portion extends to a sole structure of the article of footwear.

8. The upper of claim 1, wherein the first reinforcing layer includes a third portion extending around an opening of the upper configured to receive a foot, the third portion extending continuously around the opening from the first portion of the first reinforcing layer to the second portion of the first reinforcing layer.

9. The upper of claim 1, wherein the first portion extends continuously from the throat portion along the tongue opening at the medial side, and the second portion extends continuously from the throat portion along the tongue opening at the lateral side.

10. An upper for an article of footwear, the upper comprising:

an outer layer forming an external surface of the upper; and a first reinforcing layer disposed within the outer layer and including (i) a first portion extending along a medial side of a tongue opening of the upper, (ii) a second portion extending along a lateral side of the tongue opening, (iii) a first rib portion and a second rib portion extending from the first portion in a direction away from the tongue opening, and (iii) a third rib portion and a fourth rib portion extending from the second portion in a direction away from the tongue opening, the first rib portion being separated from the second rib portion to define a first gap extending through the first reinforcing layer, the third rib portion being separated from the fourth rib portion to define a second gap extending through the first reinforcing layer, and at least one of the first portion and the second portion extending continuously along the tongue opening.

11. The upper of claim 10, wherein the first reinforcing layer includes a third portion that extends along a cuff opening of the upper.

12. The upper of claim 11, wherein the third portion is attached to the first portion at the medial side and is attached to the second portion at the lateral side.

13. The upper of claim 10, wherein the first reinforcing layer extends around a heel region of the upper.

14. The upper of claim 10, wherein the first reinforcing layer extends continuously from the medial side of the upper to the lateral side of the upper at a heel region of the upper.

15. The upper of claim 10, wherein the tongue opening terminates at a throat portion located in an area between the medial side and the lateral side.

16. The upper of claim 15, wherein the first portion and the second portion are attached to one another at the throat portion.

17. The upper of claim 16, wherein the first portion and the second portion are integrally formed.

18. The upper of claim 10, wherein the first portion and the second portion include eyelets operable to receive a lace of the article of footwear.

19. The upper of claim 10, wherein the first reinforcing layer includes a third portion extending around an opening of the upper configured to receive a foot, the third portion extending continuously around the opening from the first portion to the second portion.

20. The upper of claim 10, wherein the first portion extends continuously along the medial side of the tongue opening, and the second portion extends continuously along the lateral side of the tongue opening.

* * * * *